United States Patent [19]

Vogelsberg

[11] 4,365,469

[45] Dec. 28, 1982

[54] SZ TWISTING DEVICE FOR TWISTING ELEMENTS OF ELECTRIC CABLES

[75] Inventor: Dieter Vogelsberg, Coburg, Fed. Rep. of Germany

[73] Assignee: Siemens Aktiengesellschaft, Munich, Fed. Rep. of Germany

[21] Appl. No.: 252,451

[22] Filed: Apr. 9, 1981

[30] Foreign Application Priority Data

Apr. 9, 1980 [DE] Fed. Rep. of Germany ..... 3013933

[51] Int. Cl.[3] ..... H01B 13/04

[52] U.S. Cl. ..... 57/293

[58] Field of Search ..... 57/6, 9, 293, 294

[56] References Cited

U.S. PATENT DOCUMENTS

| | | | |
|---|---|---|---|
| 3,187,495 | 6/1965 | Christian, Jr. | 57/293 |
| 4,056,925 | 11/1977 | Vogelsberg | 57/293 |
| 4,196,576 | 4/1980 | Vogelsberg | 57/293 X |
| 4,214,430 | 7/1980 | Vogelsberg | 57/293 X |
| 4,266,398 | 5/1981 | Vogelsberg | 57/293 |
| 4,272,951 | 6/1981 | Vogelsberg | 57/293 |

FOREIGN PATENT DOCUMENTS

| | | |
|---|---|---|
| 2615275 | 4/1976 | Fed. Rep. of Germany . |
| 2828959 | 6/1978 | Fed. Rep. of Germany . |
| 2403633 | 9/1977 | France . |

*Primary Examiner*—Donald Watkins

*Attorney, Agent, or Firm*—Kenyon & Kenyon

[57] ABSTRACT

So as to be able to perform layer-wise SZ twisting of twisting elements of electric cables by means of a twisting plate with changing direction of rotation, the twisting plate is preceded at a distance by a twisting head which revolves with constant speed and direction of rotation. The twisting plate itself is provided with guide holes for guiding the twisting elements, which holes are arranged on at least two concentric pitch circles. Advantageously, the twisting plate has, besides a central guide hole, six guide holes on a first pitch circle and twelve guide holes on a second pitch circle. The distance between the twisting head and the twisting plate should be greater than the length of a section with the same twisting direction in the finished twisted material.

3 Claims, 2 Drawing Figures

SZ TWISTING DEVICE FOR TWISTING ELEMENTS OF ELECTRIC CABLES

BACKGROUND OF THE INVENTION

This invention relates to the field of twisting technology in general and more particularly the layer-wise SZ twisting of twisting elements of electric cables in which the resulting twist is produced by means of a twisting plate with alternating direction of rotation.

Past development in the field of SZ twisting technology has led to twisting machines with which two to five twisting elements can be twisted with each other without problem. Further development in this field consequently has as an objective, among others, to also be able to twist a larger number of twisting elements with each other. This should be done within the scope of layer-wise SZ twisting.

For the layer-wise SZ twisting of twisting elements of electric cables, a twisting machine is already known which consists essentially of a customary SZ twisting portion with two twisting heads arranged respectively at the beginning and at the end of a taut twisting accummulator. The alternating rotary motion of the twisting heads is arranged so that, when the twisting elements enter the twisting machine, the lengths drawn in, on the average, are exactly those which are required in the finished twisted assembly (DE-OS No. 27 26 172). Such a twisting device is well suited for the twisting of 1+6+12 twisting elements. Applying further twisting layers however, presents difficulties because of twist reversal processes which occur. This as also true for another known twisting device which contains a separate twisting closer followed by a twisting head, for each twisting layer and in which the individual twisting heads, together with a twisting head common to all twisting layers forms several taut, interleaved twisting accummulators. The distances and speeds of rotation of the twisting heads in this device are matched to each other in a particular way (DE-OS No. 28 28 959). Particular difficulties arise in controlling the length differences of the twisting elements which occur in twist reversal processes.

For SZ twisting of 4 to 5 twisting elements another twisting device is known which contains a twisting plate, rotating with alternating direction of rotation, as the twisting tool and in which the twisting head can be arranged at a certain distance from the twisting plate immediately behind a twisting closer. The twisting head revolves with the same direction of rotation as the twisting plate but only at half the speed (DE-OS No. 24 54 777). In another known twisting device of this kind, the twisting head runs only intermittently (French Provisional Patent No. 2,403,633). SZ layer twisting of twisting elements of electric cables can also be carried out with a twisting plate, the guide holes of which are arranged on two pitch circles and which isprovided with tubular accummulators for the twisting elements of different twisting layers (DE-OS No. 26 15 275). Instead of tubular accumulators, several twisting plates can also be provided (U.S. Pat. No. 3,187,495).

SUMMARY OF THE INVENTION

Starting out from a device for the SZ twisting of twisting elements of electric cables which consists of a first twisting closer with a directly following rotating twisting head, a twisting plate which is arranged at a greater distance from the twisting head, the twisting plate rotating with alternating directions of rotation and provided with guide holes for the twisting elements, and at least one following twisting closer, it is an object of the present invention to improve this known twisting device of simple design in such a manner that it can be used for layer-wise SZ twisting.

For solving this problem, in accordance with the present invention, the twisting head involves with a direction of rotation which always remains the same, its speed of rotation being equal or approximately equal to the speed of rotation of the twisting plate, and the guide holes of the twisting plate are arranged on at least two pitch circles concentric with each other.

The further development of the known SZ twisting device provided according to the present invention allows it to now also be used for the layer-wise twisting of twisting elements, where the same advantages come to bear as in the already known twisting device, i.e., in particular an unequivocal correlation of the twisting elements (twisting geometry) as well as short reversal points of the twist direction. Because the twisting head revolves with constant speed and direction of rotation, it is then ensured that, before the twisting elements enter the linear accummulator formed between the twisting head and the twisting plate, the lengths of the twisting elements drawn into the twisting device are exactly those lengths which are required in the finally twisted condition of the twisting elements for obtaining an optimum twisting geometry.

The new SZ twisting device is suited particularly for twisting structures, in which a twisting element in the core is surrounded by a first layer of six twisting elements and a second layer of twelve twisting elements. Such twisting structures are customary particularly for control cables and control lines. For such an application it is advisable that the twisting plate has, besides a central guide hole, six guide holes on the first pitch circle and twelve guide holes on the second pitch circle. With respect to the twisting, it is characteristic of this device that all twisting layers are twisted simultaneously with the same length and direction of lay and that the twist changing points of all twisting layers are located in the same cross-sectional plane. For cables and lines for which no particular bending requirements are specified, this is not a disadvantage especially if the conductors of the wires are litz conductors.

Instead of wires, other twisting elements such as, for instance, pairs, triplets or quads can, of course, also be twisted by the new twisting device.

With respect to the practical use of the new SZ twisting device, the magnitude of the distance between the twisting head rotating at constant speed and the twisting plate revolving with changing direction of rotation is of importance. The larger this distance, the more twisting lays which can be applied per lay direction. It makes sense to choose the mentioned distance at least so large that it corresponds to the length of a section of constant twist direction in the finished twisted material. In this case it is ensured that the twisting elements in the region between the twisting head and the twisting plate are not twisted any more than in the final condition. It is advisable however, to make the mentioned distance larger, for instance, 20% larger than the length of a section of constant twist direction in the finished twisted material. In this case, the conductors in the outer layer always have a length excess in the area of the linear accummulator. This facilitates the retwisting of the outer layer in the vicinity of the twisting plate.

DETAILED DESCRIPTION

Figure 1:
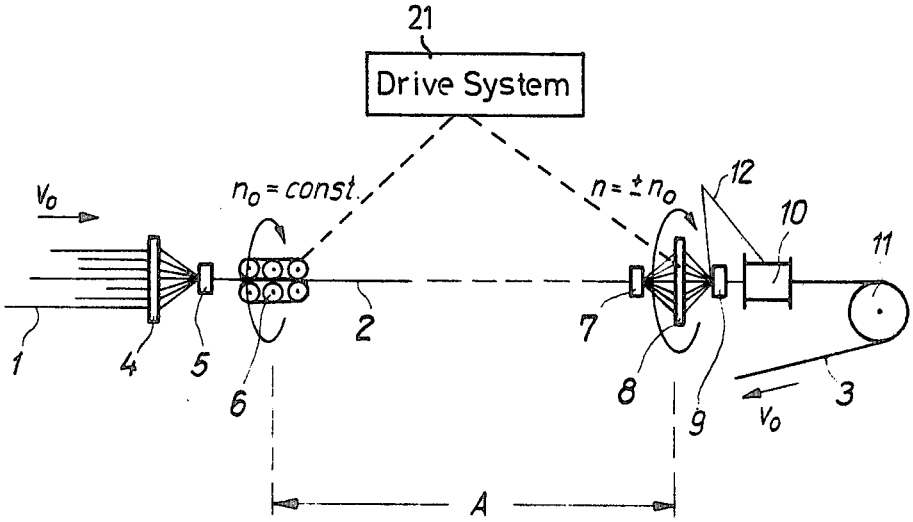
FIG. 1 is a schematic diagram of the SZ twisting device of the present invention.

FIG. 1 shows a twisting device which includes, as seen in the travel direction of the twisting elements, a stationary twisting plate 4, with guide holes or guide nipples arranged in layers, a following twisting closer 5 and a twisting head 6 connected thereto, and a twisting plate 8 which is arranged at a distance from the twisting head 6. Twisting plate 8 rotates with a direction of rotation changing at intervals, with twisting closers 7 and 9 arranged in front and behind it. A drive system 21 provides means to rotate twisting head 6 and twisting plate 8. A reverse spinner 10 is associated with the twisting closer 9 and a deflection roll or drawing-off pulley 11 is provided as the outer fixed point for the final twisting.

To produce a twisted assembly which has the structure of 1+6+12 conductors, the individual conductors 1 enter into the twisting closer 5 via the twisting plate 2 and are there twisted with each other by means of the twisting head 6 which is driven by drive system 21 such that it revolves with the same direction of rotation and constant speed of rotation $n_o$. The twisting head 6 is followed by the torsioning section of length A, the size of which is determined by the pulling off velocity $v_o$ of the twisting elements, the speed of rotation $n_o$ of the twisting plate 8 and the number N of revolutions which the twisting plate executes for each direction of rotation. The length A should accordingly be at least $v_o/n_o \times N$. After running through the torsioning section A, the strand 3 is untwisted by means of the twisting closer 7 and the twisting plate 8 and is subsequently twisted again in the twisting closer 9. The twisting plate 8 contains for this purpose, like the stationary twisting plate 4, layers of guide nipples, arranged on concentric circles, for each individual conductor, and is driven by drive system 21, also so as to rotate with a direction of rotation changing at intervals but with constant speed of rotation $n_o$. Thereby, the twisted assembly is given, in the twisting closer 9, a precise layer structure with closely limited change points of the direction of lay. The twisted assembly is preferably further wrapped, still in the twisting closer 9, with a holding helix 12 which is applied by the spinner 10. The spinner 10 is followed by the deflection pulley 11 as the outer fixed point of the final twist.

Advantageously, the constantly rotating twisting head 6 is allowed to revolve with the same speed of rotation as the twisting plate 8. Then, the conductor lengths pulled in at the twisting closer 5 correspond exactly to lengths in the twisting geometry in the finished twisted assembly 3. Upsetting effects of inner or outer conductors in the twisted assembly are therefore avoided. The finished twisted assembly 3 has the length of lay $s = \pm v_o/n_o$.

The twisted assembly usually has a greater length of lay in the region between the twisting head 6 and the twisting plate 8 and, when entering into the twisting head 6, the outer conductors, as a rule, have excess length in the region of the torsioning section A. The facilitates the retwisting of the outer layer by the twisting plate 8.

When starting up the twisting device, it is advisable, after inserting the conductors, to initially give the twisting head 6 and the twisting plate 8 the same direction of rotation. Then, the finished twisted assembly 3 running through the twisting closer 9 continuously gets right-hand lays while left-hand lays continuously enter the accumulator section. Their number increases until the twisting plate 8 changes its direction of rotation. Subsequently, the number of left-hand lays in the twisting section decreases steadily again, reaches 0 and, after the direction of rotation at the twisting head 8 is changed again, increases again linearly. It is important that the direction of lay of the strand in the accummulator section always remains the same, i.e., no twist changing points occur within the twisting section.

In order to prevent twisting lays from accummulating immediately ahead of the twisting plate 8, during the twisting process it is advantageous to let the untwisting closer 7 rotate, changing with the twisting plate 8. However, the untwisting closer 7 can also be replaced by a guide tube rigidly connected to the twisting plate 8 in order to carry the rotary motion of the twisting plate as far as possible into the twisting assembly 3 rotating in the accummulator section A. The twisted assembly which runs through the inside, rests against the guide tube under the influence of the centrifugal force. Corresponding design embodiments are described in DE-OS No. 24 54 777. This applies also in the case where one or more tube sections are arranged between the twisting head 6 and the twisting plate 8, as twisting devices which are driven at changing direction of rotation and are optionally driven at staggered speeds of rotation. These tube sections then engage the twisted assembly passing through in the manner of a slipping clutch and distribute the twisting lays executed backwards by the twisting plate 8 uniformly over the accummulator section.

For the practical embodiment of the twisting device, the procedure can be, for instance, as follows: in order to obtain in the twisted assembly a resultant length of lay of ±400 mm, the twisting plate 8 rotates, at a pulling off velocity of v=100 m/min, alternatingly with a speed of rotation $n_o = \pm 250$/min. The constant speed of rotation of the twisting head 6 likewise is $n_o = 250$/min. The twisting plate 8 changes its direction after every 20 revolutions. The length of the section A or the distance between the twisting head 6 and the twisting plate 8 would be in this case 10 m, while the length of a section with the same twist direction in the finished twisted assembly 3 is 8 m.

As already mentioned, the speed of rotation of the twisting head 6 agrees essentially with the speed of rotation of the twisting plate 8. In production practice, however, it may be advisable to choose a speed of rotation for the twisting head 6 which deviates a bit from the speed of rotation of the twisting plate 8.

Figure 2:
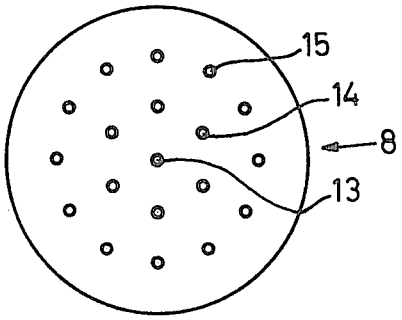
FIG. 2 is a plan view of the twisting plate of FIG. 1.

FIG. 2 shows a view of the twisting plate 8 which has a central guide hole 13. Located on a first pitch circle are the guide holes 14 for the twisting elements of the first twisting layer, and, on a second pitch circle, the guide holes 15 for the twisting elements of the second twisting layer.

What is claimed is:

1. In a device for the SZ twisting of twisting elements of electric cables, comprising: a first twisting closer; an immediately following rotating twisting head; a twisting plate arranged at a greater distance from the twisting head, said twisting plate provided with guide holes for the twisting elements; means to rotate said twisting head and to rotate said twisting plate with a changing direction of rotation; and at least one following twisting closer, the improvement comprising:

(a) the means to rotate adapted to always rotate the twisting head with the same direction of rotation, and a speed of rotation equal or approximately equal to the speed of rotation of the twisting plate; and (b) the guide holes of the twisting plate being arranged on at least two pitch circles which are concentric with each other.

2. The improvement according to claim 1, wherein said twisting plate has a central guide hole, six guide holes on a first pitch circle and twelve guide holes on a second pitch circle.

3. The improvement according to claim 1 or 2, wherein that distance between said twisting head and said twisting plate is greater than the length $l=(v_0/n_0)\times N$, where $v_o$=the pulling-off of the twisting elements, $n_o$=the speed of rotation of the twisting plate, and N=the numer of revolutions of the twisting plate in each direction of rotation.

* * * * *